US012434938B2

(12) United States Patent
Miyata

(10) Patent No.: US 12,434,938 B2
(45) Date of Patent: Oct. 7, 2025

(54) SHEET PROCESSING DEVICE

(71) Applicant: TOSHIBA TEC KABUSHIKI KAISHA, Tokyo (JP)

(72) Inventor: Kazuki Miyata, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 173 days.

(21) Appl. No.: 18/177,783

(22) Filed: Mar. 3, 2023

(65) Prior Publication Data

US 2024/0294353 A1 Sep. 5, 2024

(51) Int. Cl.

| | |
|---|---|
| ***B65H 45/30*** | (2006.01) |
| ***B65H 7/20*** | (2006.01) |
| ***B65H 37/06*** | (2006.01) |
| ***B65H 45/16*** | (2006.01) |
| ***B65H 45/18*** | (2006.01) |

(52) U.S. Cl.

CPC ..... *B65H 45/30* (2013.01); *B65H 7/20* (2013.01); *B65H 37/06* (2013.01); *B65H 45/16* (2013.01); *B65H 45/18* (2013.01); *B65H 2301/4474* (2013.01); *B65H 2511/224* (2013.01)

(58) Field of Classification Search

CPC ..... B31F 1/00; B31F 1/0006; B31F 1/0035; B65H 7/20; B65H 37/06; B65H 45/16; B65H 45/18; B65H 45/30; B65H 2301/4474; B65H 2301/51232; B65H 2511/224; B65H 2701/13212

USPC ..... 270/32, 45

See application file for complete search history.

(56) References Cited

U.S. PATENT DOCUMENTS

| | | | | |
|---|---|---|---|---|
| 7,336,921 | B2 * | 2/2008 | Suzuki | B65H 45/18 399/407 |
| 7,744,073 | B2 * | 6/2010 | Iguchi | G03G 15/6582 270/32 |
| 8,201,815 | B2 * | 6/2012 | Sasahara | G03G 15/6582 270/32 |

(Continued)

FOREIGN PATENT DOCUMENTS

| | | | | |
|---|---|---|---|---|
| JP | 2002-86987 | | 3/2002 | |
| JP | 2003182928 | A * | 7/2003 | B65H 45/18 |

OTHER PUBLICATIONS

Espacenet machine translation of JP2003182928A; https://translationportal.epo.org/emtp/translate/?ACTION=description-retrieval&COUNTRY=JP&ENGINE=google&FORMAT=docdb&KIND=A&LOCALE=en_EP&NUMBER=2003182928&OPS=ops.epo.org/3.2&SRCLANG=ja&TRGLANG=en (Year: 2003).*

*Primary Examiner* — Leslie A Nicholson, III

(74) *Attorney, Agent, or Firm* — Amin, Turocy & Watson, LLP

(57) ABSTRACT

According to one embodiment, a sheet processing device includes a pair of folding rollers, a blade, and a fold-enhancing unit. The pair of folding rollers are provided rotatably about an axial line extending in an axial direction. The pair of folding rollers form a first nip. The blade pushes a sheet into the first nip along an imaginary reference plane including the first nip. The blade forms a fold line on the sheet in cooperation with the pair of folding rollers. The fold-enhancing unit enhances the fold line on the sheet passed through the first nip. The fold-enhancing unit includes a first member and a second member. The first member and the second member form a second nip on one side of the imaginary reference plane along a direction of a normal line to the imaginary reference plane and sandwich the fold line.

14 Claims, 10 Drawing Sheets

(56) References Cited

U.S. PATENT DOCUMENTS

| | | | | |
|---|---|---|---|---|
| 8,459,631 | B2 * | 6/2013 | Ishikawa | B42B 4/00 270/32 |
| 11,414,293 | B2 * | 8/2022 | Iwai | B65H 37/06 |
| 2014/0077436 | A1 | 3/2014 | Hata et al. | |
| 2015/0375957 | A1 | 12/2015 | Fukasawa et al. | |
| 2020/0307945 | A1 | 10/2020 | Mori et al. | |

* cited by examiner

SHEET PROCESSING DEVICE

FIELD

Embodiments described herein relate generally to a sheet processing device.

BACKGROUND

A sheet processing device includes a folding unit that folds a sheet and thus forms a fold line thereon, and a fold-enhancing unit that enhances the fold line on the sheet. A sheet processing device that can form a uniform fold line regardless of the number of sheets is demanded.

DETAILED DESCRIPTION

In general, according to one embodiment, a sheet processing device includes a pair of folding rollers, a blade, and a fold-enhancing unit. The pair of folding rollers are provided rotatably about an axial line extending in an axial direction. The pair of folding rollers form a first nip. The blade pushes a sheet into the first nip along an imaginary reference plane including the first nip. The blade forms a fold line on the sheet in cooperation with the pair of folding rollers. The fold-enhancing unit enhances the fold line on the sheet passed through the first nip. The fold-enhancing unit includes a first member and a second member. The first member and the second member form a second nip on one side of the imaginary reference plane along a direction of a normal line to the imaginary reference plane and sandwich the fold line.

The sheet processing device according to the embodiment will now be described with reference to the drawings. In the description below, components having the same or similar functions are denoted by the same reference sign. The repeated explanation of such components may be omitted.

Figure 1:
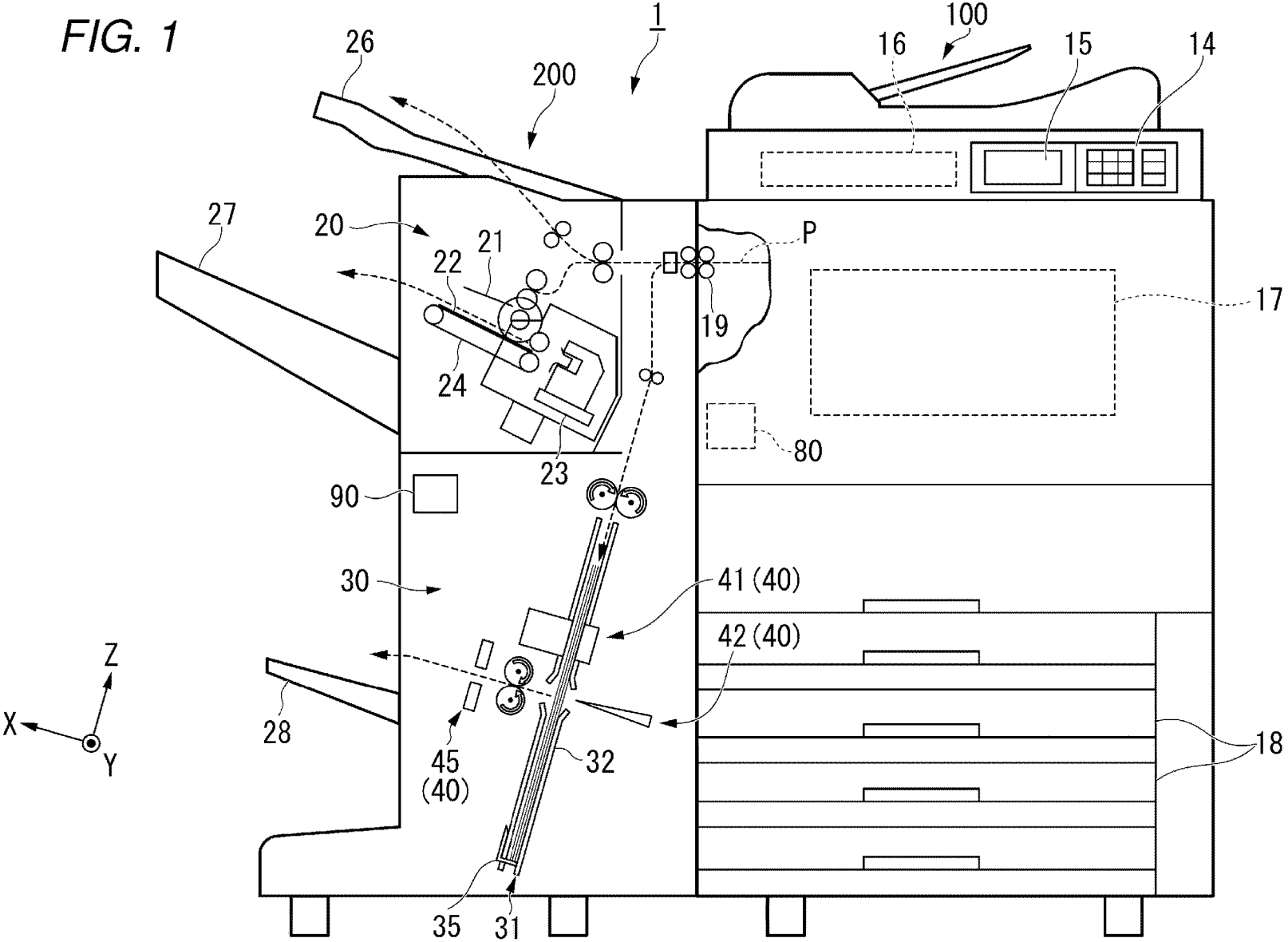
FIG. 1 is a view of a schematic configuration of an image forming device.

FIG. 1 is a view of a schematic configuration of an image forming device 1. For example, the image forming device 1 is arranged at a workplace. The image forming device 1 includes an image forming device main body 100 and a sheet processing device 200. The image forming device main body 100 and the sheet processing device 200 are arranged next to each other.

The image forming device main body 100 will now be described.

The image forming device main body 100 forms an image on a sheet P (recording medium), using a recording agent. The sheet P is, for example, a normal paper or a sticker paper. A specific example of the recording agent is a toner. The toner is either a toner used as a decolorable recording agent or a toner used as a non-decolorable recording agent.

The image forming device main body 100 is, for example, a multifunction peripheral. As shown in FIG. 1, the image forming device main body 100 includes a display unit 15, an operation unit 14, an image reading unit 16, a printer unit 17, a sheet container unit 18, a paper discharge roller 19, and a first control unit 80.

The display unit 15 is an image display device such as a liquid crystal display or an organic EL (electroluminescence) display. The display unit 15 displays various information about the image forming device main body 100 and the sheet processing device 200.

The operation unit 14 has a plurality of buttons. The operation unit 14 accepts a user's operation. The operation unit 14 outputs a signal corresponding to an operation carried out by the user, to the first control unit 80 of the image forming device main body 100. The display unit 15 and the operation unit 14 may be formed as an integrated touch panel.

The image reading unit 16 reads image information of a reading target, based on the brightness and darkness of light. The image reading unit 16 outputs the read image information to the printer unit 17.

The sheet container unit 18 contains the sheet P to be used for image formation. The sheet container unit 18 supplies the sheet P contained therein, to the printer unit 17.

The printer unit 17 forms an image on a sheet, based on image information generated by the image reading unit 16 or image information received via a communication line. The printer unit 17 includes an image forming unit, a transfer unit, and a fixing device. The image forming unit forms an electrostatic latent image on a photosensitive drum, based on the image information. The image forming unit causes a toner to adhere to the electrostatic latent image and thus forms a visible image. The transfer unit transfers the visible image onto the sheet. The fixing device heats and pressurizes the toner and thus fixes the visible image onto the sheet.

The paper discharge roller 19 is arranged near a paper discharge port of the image forming device main body 100. The paper discharge roller 19 sends out the sheet P with an image formed thereon, to the sheet processing device 200.

Figure 2:
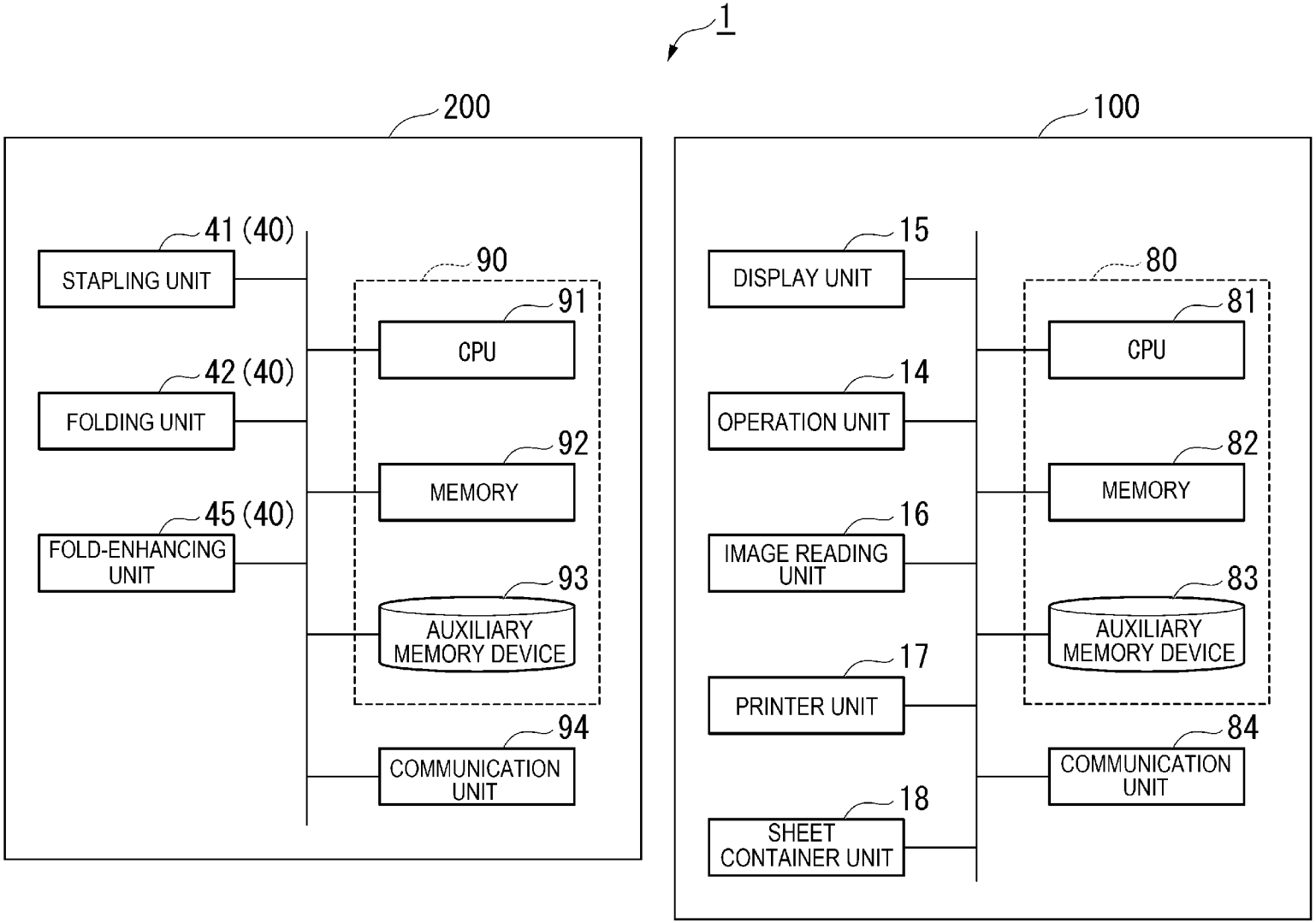
FIG. 2 is a block diagram showing an example of a functional configuration of the image forming device.

FIG. 2 is a block diagram showing an example of the functional configuration of the image forming device 1. As shown in FIG. 2, the image forming device main body 100 includes a CPU (central processing unit) 81, a memory 82, and an auxiliary memory device 83 or the like coupled via a bus, and executes a program. By executing the program, the image forming device main body 100 functions as a device including the display unit 15, the operation unit 14, the image reading unit 16, the printer unit 17, the sheet container unit 18, and a communication unit 84.

The CPU 81 executes a program stored in the memory 82 and the auxiliary memory device 83 and thus functions as the first control unit 80. The first control unit 80 controls the operation of each part of the image forming device main body 100.

The auxiliary memory device 83 is formed using a memory device such as a magnetic hard disk device or a semiconductor memory device. The auxiliary memory device 83 stores information.

The communication unit 84 is formed including a communication interface for connecting the own device to an external device. The communication unit 84 communicates with the external device via the communication interface.

The sheet processing device 200 will now be described.

As shown in FIG. 1, the sheet processing device 200 performs post-processing on the sheet P with an image formed thereon. For example, the post-processing is stapling or V-folding or the like. The sheet processing device 200 includes a stapling mechanism 20, a V-folding mechanism 30, and a second control unit (control unit) 90.

The stapling mechanism 20 includes a standby tray 21, a processing tray 22, and a stapler 23. The stapler 23 performs stapling at a peripheral edge part of a plurality of sheets P. Hereinafter, a plurality of sheets P is referred to as a sheet bundle. The stapled sheet P is conveyed by a conveyor belt 24 and discharged to a movable tray 27.

The sheet processing device 200 includes the movable tray 27, an upper tray 26, and a lower tray 28. A stapled sheet P is discharged to the movable tray 27. A sheet P that is not stapled is discharged to the upper tray 26. The lower tray 28 is located at a lower part of the sheet processing device 200. A sheet P processed by the V-folding mechanism 30 is discharged to the lower tray 28.

First Embodiment

Figure 3:
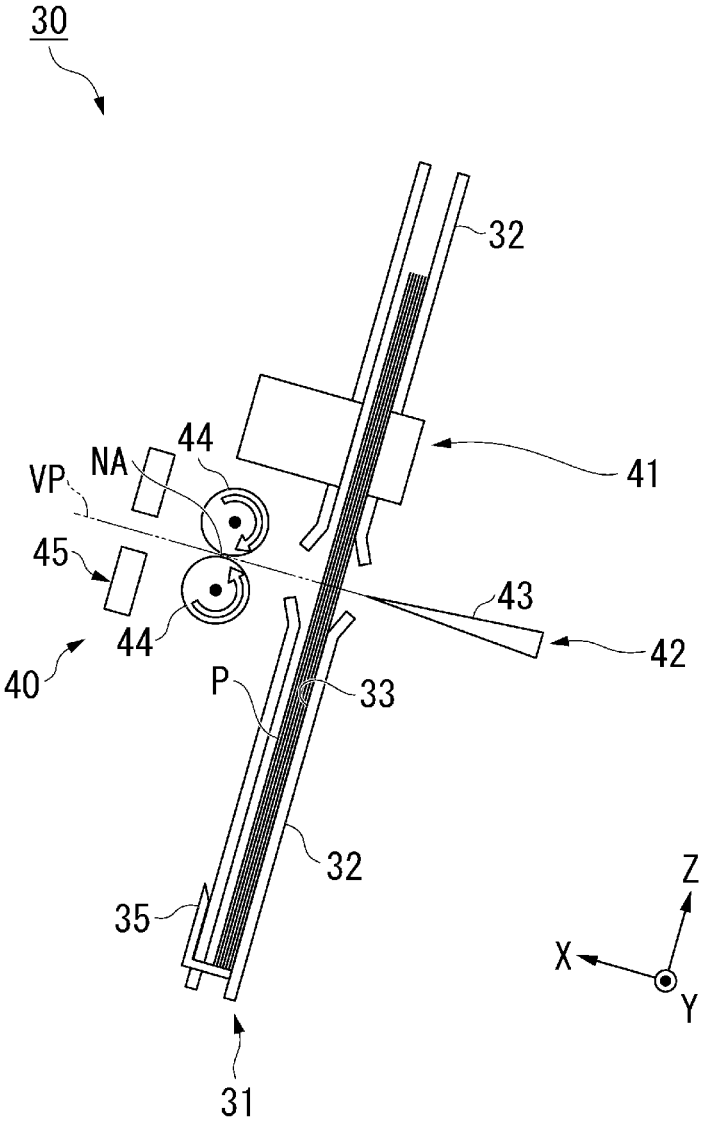
FIG. 3 is a front view showing a schematic configuration of a V-folding mechanism in a sheet processing device according to a first embodiment.

FIG. 3 is a front view showing a schematic configuration of the V-folding mechanism 30 in the sheet processing device 200 according to a first embodiment. As shown in FIG. 3, the V-folding mechanism 30 includes a sheet support unit 31 and a post-processing unit 40. The post-processing unit 40 includes a stapling unit 41, a folding unit 42, and a fold-enhancing unit 45.

The sheet support unit 31 is provided at a downstream end in the direction of conveyance of the sheet P in a conveyor path of the sheet P. The sheet P is stacked in the sheet support unit 31. The sheet support unit 31 includes a bed 32 and a stacker 35. The bed 32 has a paper stacking surface 33 supporting the surface of the sheet P.

As a local coordinate system of the V-folding mechanism 30, an X-direction, a Y-direction, and a Z-direction in an orthogonal coordinate system are defined as follows. The X-direction is the direction of a normal line to the paper stacking surface 33 of the bed 32. A +X-direction is a direction in which the sheet P is placed on the bed 32. The +X-direction is a direction tilted upward from the horizontal direction. The Z-direction is the direction of conveyance of the sheet P in the V-folding mechanism 30. A −Z-direction is a direction in which the sheet P moves toward the sheet support unit 31 through the conveyance path. The −Z-direction is a direction tilted downward from the horizontal direction. The Y-direction is the horizontal direction.

The bed 32 is substantially plate-shaped and configured in such a way that the sheet P can be placed on the paper stacking surface 33 facing in the +X-direction. The bed 32 is located on both sides of the folding unit 42 along the Z-direction. The sheet P arranged on the paper stacking surface 33 is supported by the stacker 35. The stacker 35 regulates the distal end in the −Z-direction of the sheet P conveyed to the sheet support unit 31. The stacker 35 is movable along the Z-direction. For example, the stacker 35 is driven by a moving mechanism arranged in the −X-direction from the bed 32.

The stapling unit 41 processes the sheet P at a position further in the +Z-direction than the position where the sheet P is supported by the stacker 35. The stapling unit 41 is located in the +Z-direction from the folding unit 42. The stapling unit 41 performs stapling at a predetermined position on the sheet P. For example, the predetermined position on the sheet P is a center part in the Z-direction of the sheet P.

The folding unit 42 processes the sheet P at a position further in the +Z-direction than the position where the sheet P is supported by the stacker 35. The folding unit 42 folds the center part in the Z-direction of the sheet P and thus forms a fold line F on the sheet P. The folding unit 42 includes a pair of folding rollers 44 and a blade 43.

The pair of folding rollers 44 are located in the +X-direction from the bed 32. The pair of folding rollers 44 are arrayed in the Z-direction. The axial lines of rotation of the pair of folding rollers 44 extend in the Y-direction. The pair of folding rollers 44 are drive rollers. However, one of the pair of folding rollers 44 may be a driven roller. Each of the pair of folding rollers 44 is displaceable in the Z-direction. The pair of folding rollers 44 can be displaced in the Z-direction and thus can move toward and away from each other. The pair of folding rollers 44 are interlocked with each other in the displacement in the Z-direction. The pair of folding rollers 44 come into contact with each other and form a first nip NA. The first nip NA is a contact area of the pair of folding rollers 44. An XY plane including the first nip NA is defined as an imaginary reference plane VP.

The blade 43 is flat plate-shaped and parallel to the XY plane. The blade 43 is tapered as it goes in the +X-direction. The blade 43 is movable in the X-direction along the imaginary reference plane VP, passing through the bed 32. The blade 43 pushes the sheet P into the first nip NA and thus forms the fold line F on the sheet P in cooperation with the pair of folding rollers 44.

The fold-enhancing unit 45 is located in the +X-direction from the pair of folding rollers 44. The fold-enhancing unit 45 enhances the fold line F on the sheet P.

The V-folding mechanism 30 can execute, for example, bookbinding of a sheet bundle. In the bookbinding, stapling and V-folding are performed on a sheet bundle stacked in the sheet support unit 31.

In the bookbinding, first, stapling is performed on the sheet bundle. The stacker 35 moves the sheet bundle in the +Z-direction and causes the center part in the Z-direction of the sheet bundle to coincide with the position of the stapling unit 41. The stapling unit 41 performs stapling on the sheet bundle.

Subsequently, V-folding is performed on the stapled sheet bundle. The stacker 35 moves the sheet bundle in the −Z-direction and causes the center part in the Z-direction of the sheet bundle to coincide with the position of the blade 43. The blade 43 moves in the +X-direction and pushes the center part of the sheet bundle in between the pair of folding rollers 44. The sheet bundle is V-folded at the center part in the Z-direction. The fold line F is formed on the end side in the +X-direction of the sheet bundle in the V-folded state. The fold-enhancing unit 45 enhances the fold line F on the sheet bundle. The bookbinding of the sheet bundle is thus completed. The sheet bundle thus bound into a book is discharged to the lower tray 28.

The V-folding mechanism 30 can perform V-folding without performing stapling on one or more sheets P stacked in the sheet support unit 31, instead of the bookbinding. The one or more sheets P is one sheet P or a sheet bundle. In this case, the stacker 35 directly conveys the one or more sheets P from stack the position to the folding unit 42. Subsequently, as in the V-folding in the bookbinding, a fold line is formed collectively on the one or more sheets P. The sheet P with the fold line formed thereon is discharged to the lower tray 28.

As shown in FIG. 2, the sheet processing device 200 includes a CPU (central processing unit) 91, a memory 92, and an auxiliary memory device 93 or the like coupled via a bus, and executes a program. By executing the program, the sheet processing device 200 functions as a device including the stapling mechanism 20, the V-folding mechanism 30, and a communication unit 94.

The CPU 91 executes a program stored in the memory 92 and the auxiliary memory device 93 and thus functions as the second control unit 90. The second control unit 90 controls the operation of each part of the sheet processing device 200.

The auxiliary memory device 93 is formed using a memory device such as a magnetic hard disk device or a semiconductor memory device. The auxiliary memory device 93 stores information.

The communication unit 94 is formed including a communication interface for connecting the own device to an external device. The communication unit 94 communicates with the external device via the communication interface.

The fold-enhancing unit 45 will now be described.

Figure 4:
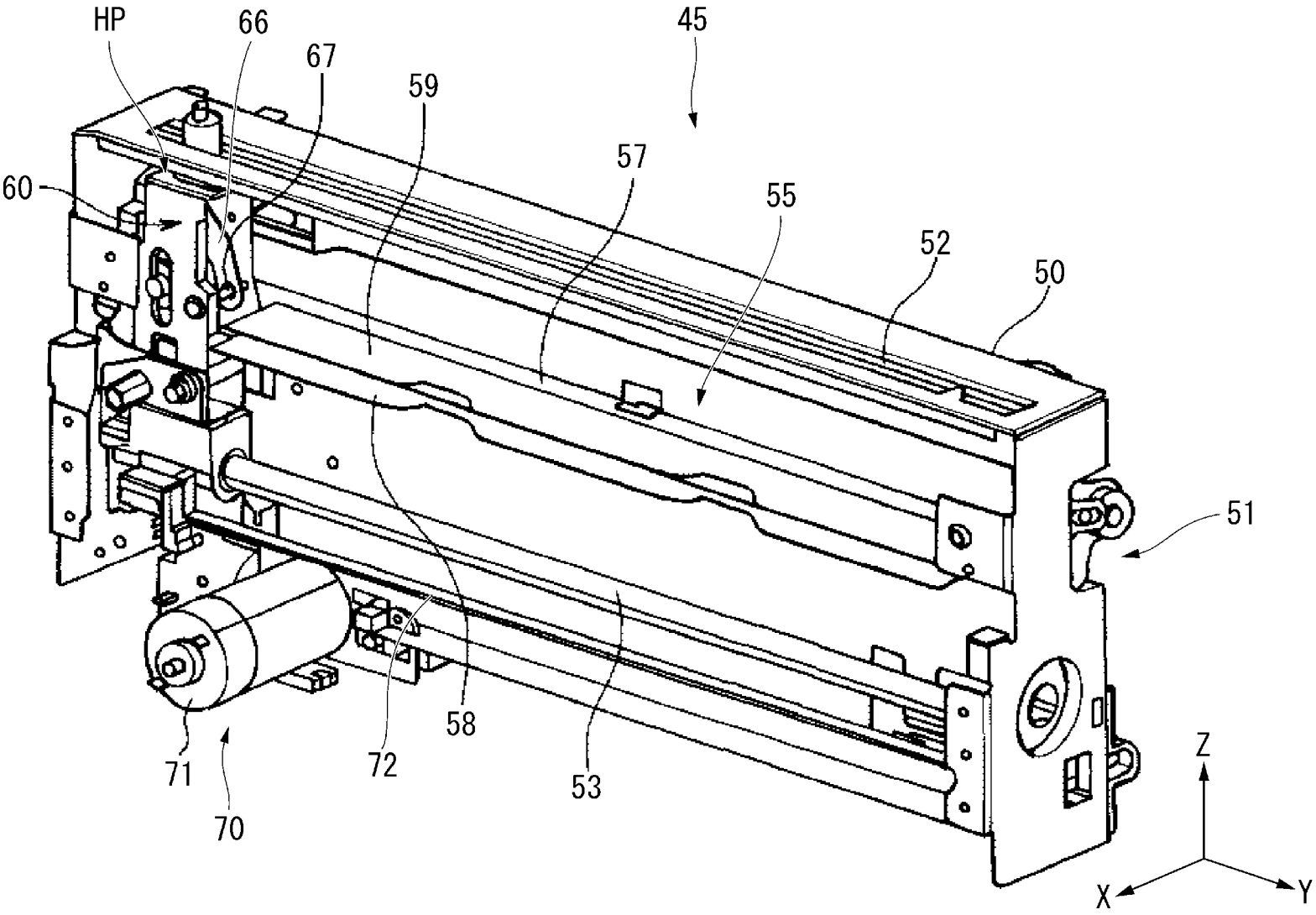
FIG. 4 is a perspective view of a fold-enhancing unit in the sheet processing device.
Figure 5:
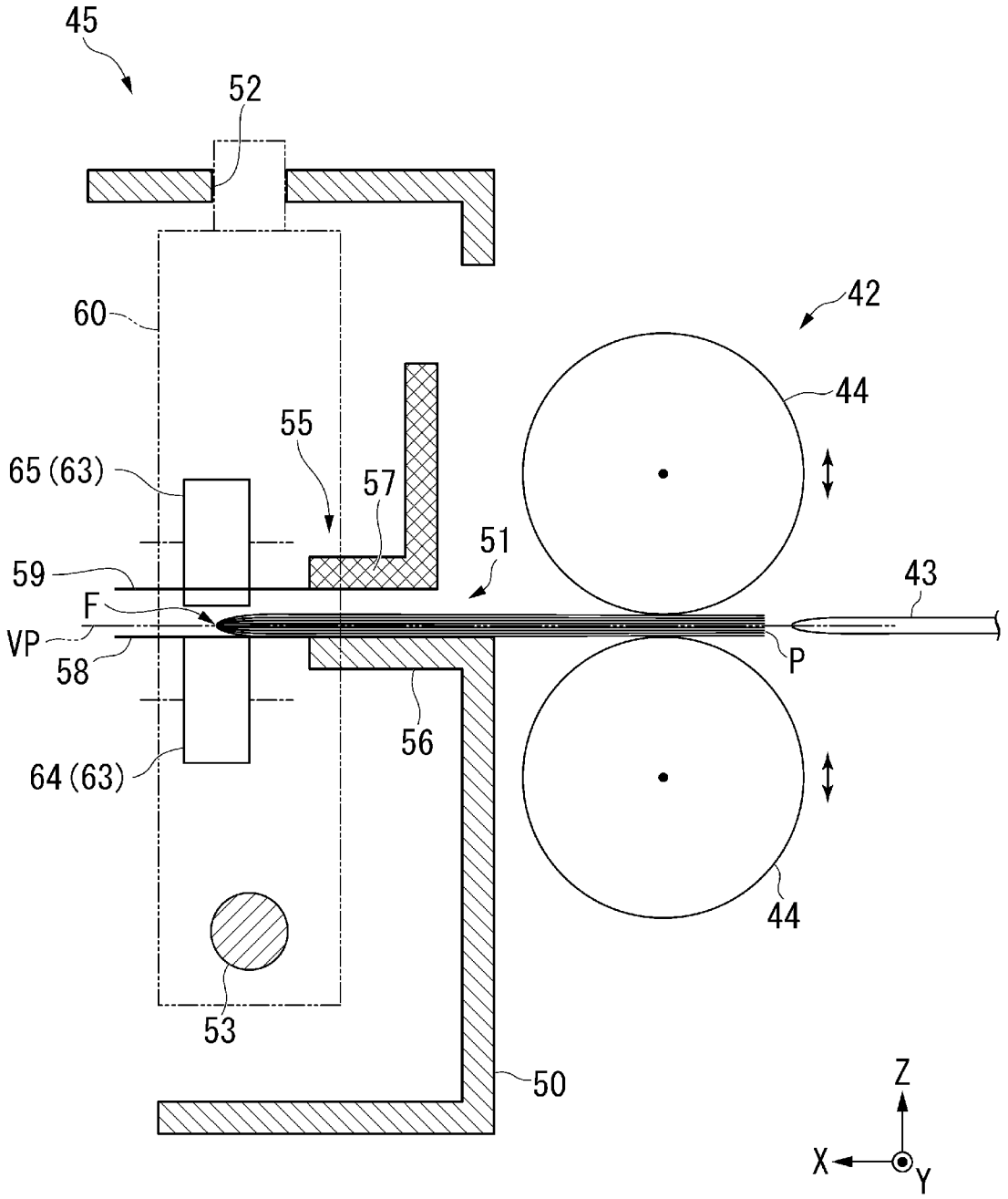
FIG. 5 is a front cross-sectional view showing a schematic configuration of a folding unit and the fold-enhancing unit in the sheet processing device.

FIG. 4 is a perspective view of the fold-enhancing unit 45 in the sheet processing device 200 according to the first embodiment. FIG. 5 is a front cross-sectional view showing a schematic configuration of the folding unit 42 and the fold-enhancing unit 45 in the sheet processing device 200 according to the first embodiment. As shown in FIGS. 4 and 5, the fold-enhancing unit 45 includes a frame 50, a support unit 55, a roller unit 60, and a drive unit 70. In the description below, the fold-enhancing unit 45 is described as in a standby state before a fold-enhancing operation unless described otherwise.

The frame 50 covers the −X-direction, the +Z-direction, the +Y-direction, and the −Y-direction of the fold-enhancing unit 45. The frame 50 has a main plate in the −X-direction. The main plate has a slit 51 extending in the Y-direction. As shown in FIG. 5, the imaginary reference plane VP passes through the slit 51. The slit 51 allows the entry of the sheet P that is V-folded by the folding unit 42. As shown in FIG. 4, the frame 50 has a top plate in the +Z-direction. The top plate has a guide hole 52 extending in the Y-direction. The frame 50 has a pair of side plates in the +Y-direction and the −Y-direction. The pair of side plates support the two ends of a guide bar 53 extending in the Y-direction. The guide hole 52 and the guide bar 53 guide the movement of the roller unit 60 in the Y-direction.

As shown in FIG. 5, the support unit 55 includes a first support plate 56, a second support plate 57, a first film 58, and a second film 59. The first support plate 56 and the second support plate 57 are parallel to the XY plane.

The first support plate 56 is located in the −Z-direction from the imaginary reference plane VP. The first support plate 56 is fixed to the frame 50. The first support plate 56 supports the sheet P from the −Z-direction.

The second support plate 57 is located in the +Z-direction from the first support plate 56. The second support plate 57 is located on the other side of the imaginary reference plane VP from the first support plate 56. The second support plate 57 is movable in the Z-direction. The second support plate 57 presses the sheet P into the −Z-direction from the +Z-direction.

The first film 58 and the second film 59 are formed in the shape of a film made of a resin material or the like and are flexible. The first film 58 and the second film 59 extend in the Y-direction.

The first film 58 is fixed to the end in the +X-direction of the first support plate 56. The first film 58 protrudes in the +X-direction from the first support plate 56. The first film 58 covers the fold line F on the sheet P from the −Z-direction.

The second film 59 is fixed to the end in the +X-direction of the second support plate 57. The second film 59 protrudes in the +X-direction from the second support plate 57. The second film 59 is movable in the Z-direction together with the second support plate 57. The second film 59 covers the fold line F on the sheet P from the +Z-direction.

Figure 6:
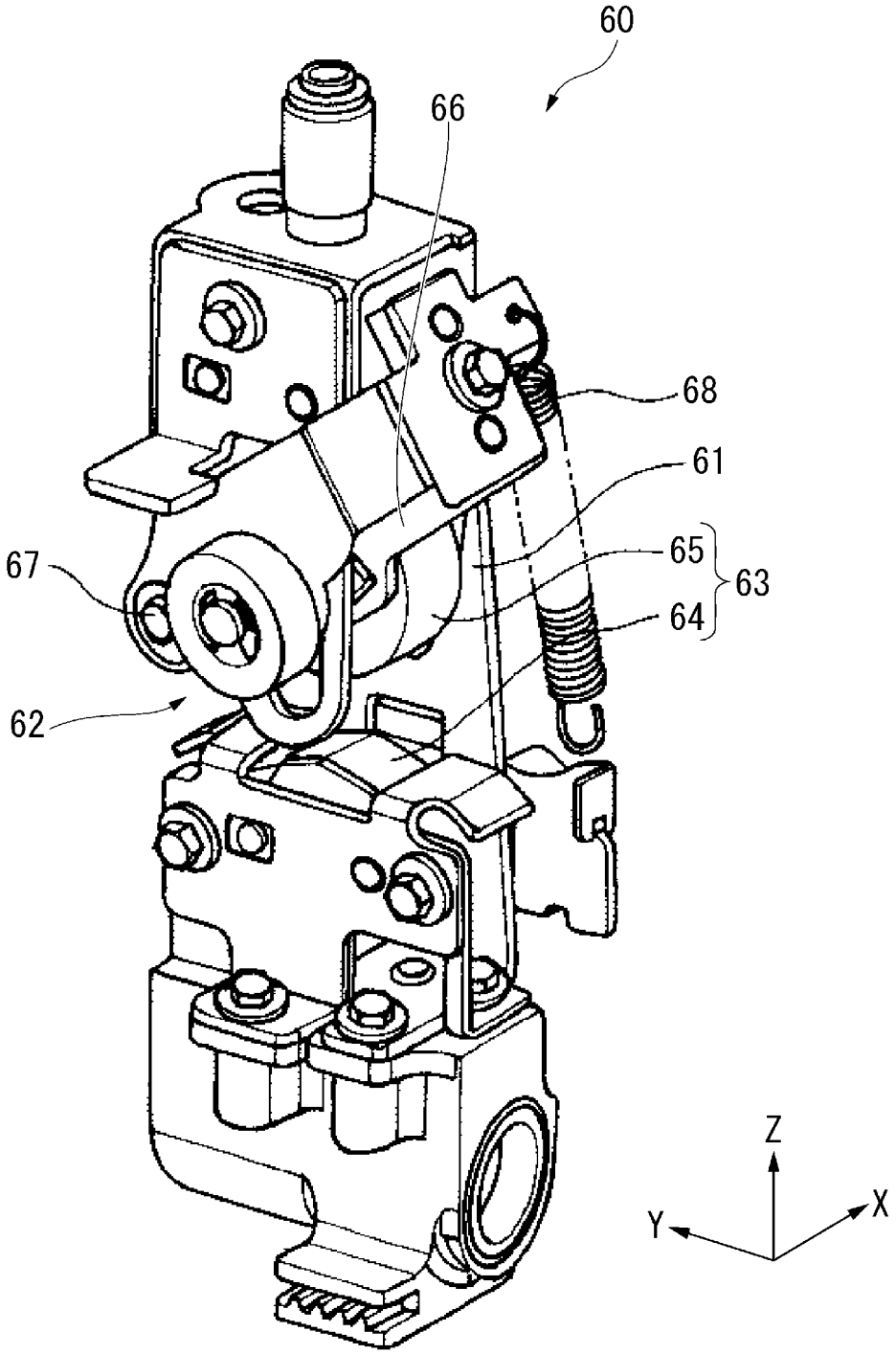
FIG. 6 is a perspective view of a roller unit in the sheet processing device.

FIG. 6 is a perspective view of the roller unit 60 in the sheet processing device 200 according to the first embodiment. As shown in FIG. 6, the roller unit 60 includes a roller frame 61 and a fold-enhancing roller 63.

The roller frame 61 is formed substantially in a C-shape as viewed from the Y-direction and has an opening 62 in the −X-direction. The opening 62 prevents the interference between the sheet P that has entered the fold-enhancing unit 45 and the roller unit 60.

The fold-enhancing roller 63 includes a first roller (first member) 64 and a second roller (second member) 65. The axial lines of rotation of the first roller 64 and the second roller 65 extend in the X-direction. The diameters of the first roller 64 and the second roller 65 are substantially the same as each other. The widths in the X-direction of the first roller 64 and the second roller 65 are substantially the same as each other. The first roller 64 and the second roller 65 are arrayed in the Z-direction.

The first roller 64 is arranged in the −Z-direction from the opening 62 and inside the roller frame 61. The first roller 64 is supported in a rotatable state by the roller frame 61. The second roller 65 is arranged in the +Z-direction from the opening 62 and inside the roller frame 61. The second roller 65 is supported in a rotatable state by an arm member 66. The arm member 66 is supported in a pivotally movable state around a pivot shaft 67 by the roller frame 61. A coil spring 68 is attached to the arm member 66. The distance between the second roller 65 and the imaginary reference plane VP is equal to or longer than the distance between the first roller 64 and the imaginary reference plane VP.

Figure 7:
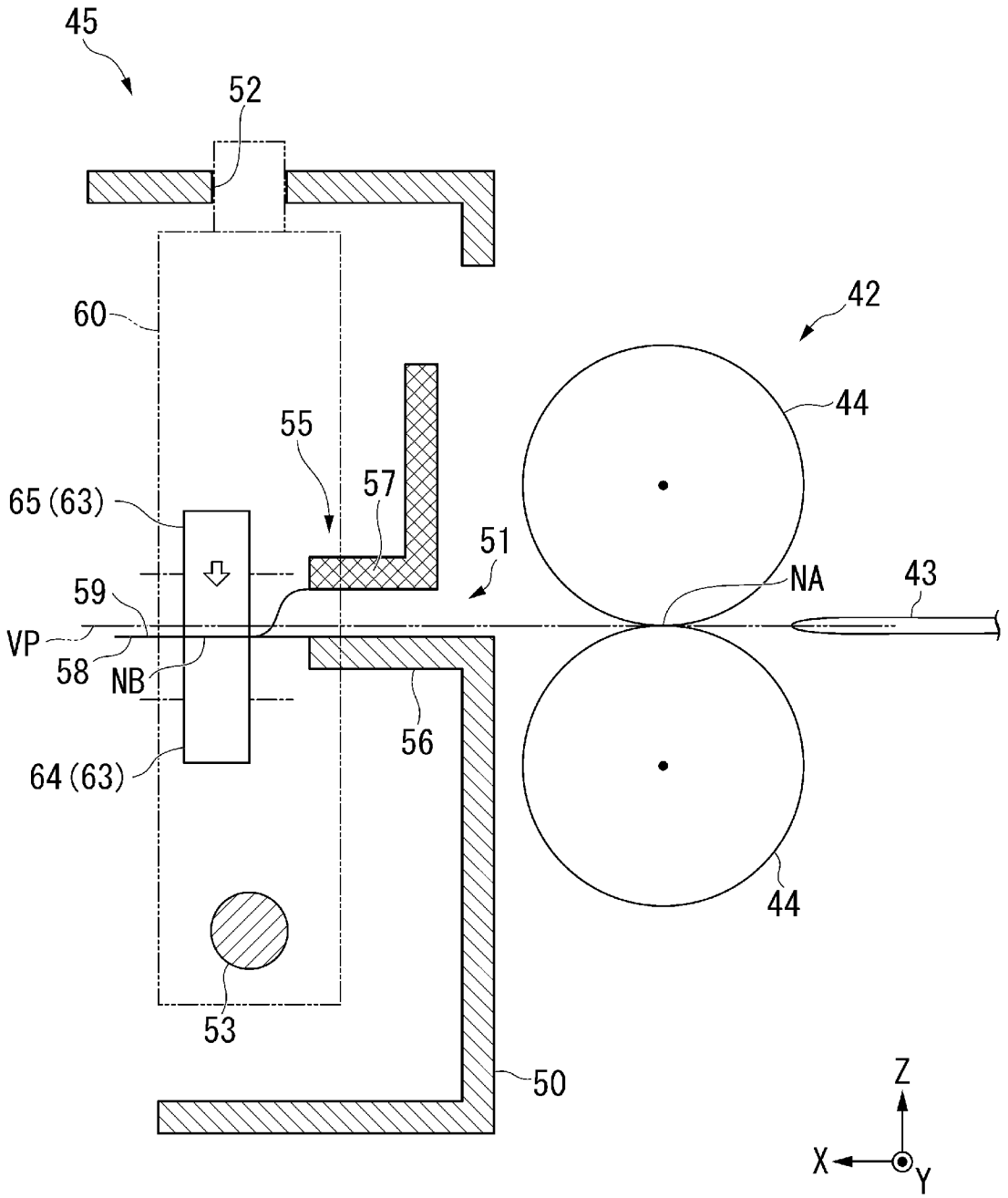
FIG. 7 is an explanatory view of an operation of the fold-enhancing unit shown in FIG. 5.

FIG. 7 is an explanatory view of the operation of the fold-enhancing unit 45 shown in FIG. 5. As shown in FIG. 7, the first roller 64 and the second roller 65 are displaced relatively to each other in the Z-direction and thus can move toward and away from each other. In this embodiment, the first roller 64 is immovable in the Z-direction. The first roller 64 and the second roller 65 come into contact with each other via the first film 58 and the second film 59 and thus form a second nip NB. The second nip NB is a contact area of the first roller 64 and the second roller 65 in the case where the first film 58 and the second film 59 are not arranged. In this embodiment, the second nip NB coincides with the contact area of the first film 58 and the second film 59 between the first roller 64 and the second roller 65. The second nip NB is parallel to the imaginary reference plane VP. The second nip NB is formed further in the −Z-direction than the imaginary reference plane VP. The space between the imaginary reference plane VP and the first roller 64 is equal to or greater than a maximum thickness of a sheet bundle that can be folded by the folding unit 42. In this embodiment, the space between the imaginary reference plane VP and the first roller 64 coincides with the maximum thickness of the sheet bundle that can be folded by the folding unit 42. The maximum thickness is the thickness of the sheet bundle before folding. For example, the maximum thickness is the thickness as of when at least one of the first control unit 80 and the second control unit 90 determines whether V-folding can be performed or not.

The drive unit 70 is located in the −Z-direction from the fold-enhancing unit 45, as shown in FIG. 4. The drive unit 70 includes a drive belt 72 and a motor 71.

The drive belt 72 is supported between a pair of pulleys spaced apart in the Y-direction. The axes of rotation of the pair of pulleys are parallel to the X-direction. A part of the drive belt 72 is coupled to the roller unit 60. The motor 71 circularly moves the drive belt 72 via the pulleys. Thus, the roller unit 60 moves in the Y-direction.

As shown in FIG. 3, when the V-folding mechanism 30 is in operation, the blade 43 pushes the center part in the Z-direction of the sheet P in between the pair of folding rollers 44. The fold line F on the sheet P is formed on the end side in the +X-direction of the sheet P in the V-folded state. The pair of folding rollers 44 move the sheet P in the +X-direction. As shown in FIG. 5, when the fold line F on the sheet P has reached the space between the first film 58 and the second film 59 in the fold-enhancing unit 45, the movement of the sheet P stops.

The fold-enhancing unit 45 in this embodiment enhances the fold line F on the sheet P in the following manner. The second control unit 90 controls the operation of each part of the fold-enhancing unit 45. The second control unit 90 performs the fold-enhancing operation described below, only if the number of sheets P to be V-folded is equal to or greater than a predetermined number. However, the second control unit 90 may perform the fold-enhancing operation described below regardless of the number of sheets P to be V-folded.

The second support plate 57 and the second film 59 of the support unit 55 move in the −Z-direction. The sheet P is sandwiched between the second support plate 57 and the second film 59, and the first support plate 56 and the first film 58. The fold line F on the sheet P is sandwiched between the first film 58 and the second film 59.

As shown in FIG. 4, the end in the −Y-direction on the inner side of the frame 50 is a home position HP of the roller unit 60. When the V-folding mechanism 30 is not in operation, the roller unit 60 waits at the home position HP. At the home position HP, the second roller 65 of the fold-enhancing roller 63 shown in FIG. 6 is spaced apart from the first roller 64 in the +Z-direction.

As the sheet P enters the fold-enhancing unit 45, the roller unit 60 moves in the +Y-direction from the home position HP. With the movement of the roller unit 60, the coil spring 68 pulls down the arm member 66 in the −Z-direction. The second roller 65 supported by the arm member 66 moves in the −Z-direction and approaches the first roller 64.

Figure 8:
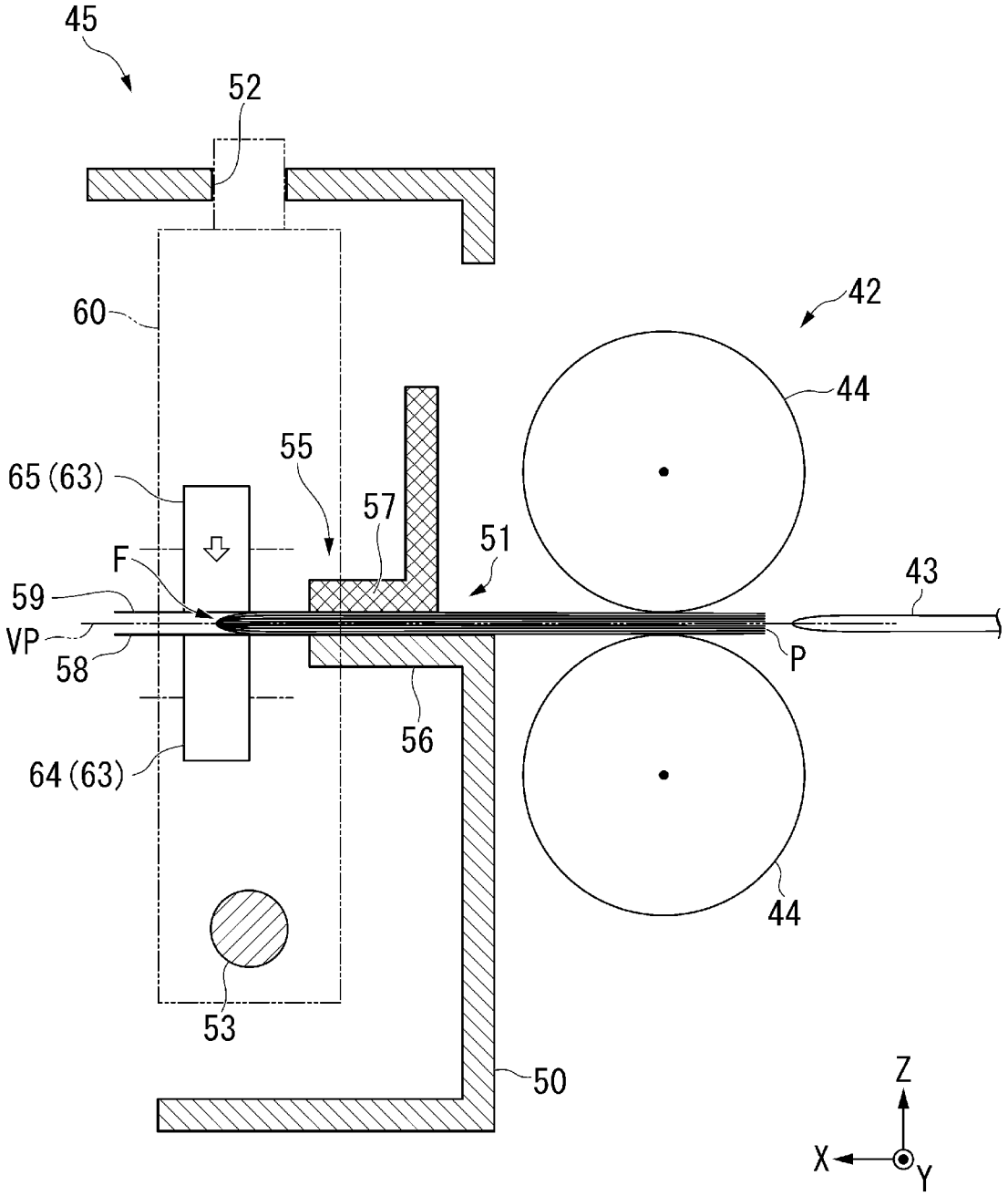
FIG. 8 an explanatory view of an operation of the fold-enhancing unit.

FIG. 8 is an explanatory view of the operation of the fold-enhancing unit 45 shown in FIG. 5. As shown in FIG. 8, the first roller 64 abuts against the surface in the −Z-direction of the first film 58. The second roller 65 abuts against the surface in the +Z-direction of the second film 59. The first roller 64 and the second roller 65 sandwich the fold line F on the sheet P via the first film 58 and the second film 59. The coil spring 68 shown in FIG. 6 energizes the arm member 66 in the −Z-direction. The second roller 65 supported by the arm member 66 presses the fold line F on the sheet P via the second film 59. The fold-enhancing roller 63 moves in the Y-direction along the fold line F. Thus, the fold line F on the sheet P is enhanced. In the above fold-enhancing operation by the fold-enhancing unit 45, the sheet P is in the state of being sandwiched between the pair of folding rollers 44.

If the sheet bundle passed through the space between the pair of folding rollers 44 is relatively thick, the sheet bundle bulges from the fold line F as the starting point. The sheet bundle bulges to both sides in the Z-direction, which is the direction of the thickness thereof. If the second nip is formed on the imaginary reference plane VP or nearer to the second roller 65 than the imaginary reference plane VP, the bulge of the sheet bundle gathers to the side of the second roller 65 and the bulge becomes uneven as viewed from the Y-direction. In this case, the bulge of the sheet bundle is pushed by the second roller 65 at a position more distant from the imaginary reference plane VP than the first roller 64 and therefore has no space to escape to. Consequently, the contact site of the fold-enhancing roller 63 with the sheet bundle is asymmetrical in relation to the fold line F. The fold-enhancing unit 45 may form a new fold line at a site shifted from the fold line F on the sheet bundle.

The fold-enhancing unit 45 in this embodiment includes the first roller 64 and the second roller 65 forming the second nip NB further in the −Z-direction than the imaginary reference plane VP and sandwiching the fold line F. This configuration can restrain the bulge of the sheet bundle from gathering in the +Z-direction even if the sheet bundle passed through the space between the pair of folding rollers 44 is relatively thick. Thus, the contact site of the first roller 64 and the second roller 65 with the sheet bundle can be restrained from becoming asymmetrical in relation to the fold line F and therefore the fold line F can be reinforced. Therefore, a uniform fold line F can be formed regardless of the number of sheets P.

The fold-enhancing unit 45 causes the second roller 65 to approach the first roller 64, which is not displaced in the Z-direction, and thus to sandwich the fold line F. In this configuration, the sheet P held between the pair of folding rollers 44 so as not to be displaced in the Z-direction is supported by the first roller 64, which is similarly not displaced in the Z-direction. Therefore, the sheet P in a stable posture can be sandwiched by the first roller 64 and the second roller 65. Thus, an unexpected displacement of the sheet P when the sheet P is sandwiched by the first roller 64 and the second roller 65 can be restrained and a more uniform fold line F can be formed. Also, unlike in a configuration where both the first roller 64 and the second roller 65 are displaced in the Z-direction, the force to sandwich the fold line F can be acquired simply via the coil spring 68 coupled to the second roller 65. Therefore, an appropriate load for sandwiching the fold line F can be easily set.

The fold-enhancing unit 45 includes the first roller 64 and the second roller 65 moving along the fold line F. This configuration can reinforce the fold line F while sequentially moving the fold-enhancing site and therefore can reinforce the fold line F with a lower load than a configuration where the fold line F is sandwiched over a broad range at a time. Also, the sliding of the first roller 64 on the first film 58 is restrained to the minimum and therefore damage to the first film 58 can be restrained. The same applies to the relationship between the second film 59 and the second roller 65. Therefore, deterioration of the first film 58 and the second film 59 can be restrained and reliability can be improved. If the support unit 55 does not include the first film 58 and the second film 59, the sliding of the first roller 64 and the second roller 65 on the sheet P can be restrained to the minimum. Thus, the formation of a trace of sliding on the sheet P is restrained and a V-folded sheet P of high quality can be formed.

In the fold-enhancing unit 45, the fold line F is sandwiched by the first roller 64 and the second roller 65 moving along the fold line F. This configuration can restrain deterioration of both the first film 58 and the second film 59 and can improve reliability.

The axial line of rotation of each of the first roller 64 and the second roller 65 extends in the X-direction. In this configuration, the second nip NB is parallel to the imaginary reference plane VP and therefore the sheet P passed through the space between the pair of folding rollers 44 can be sandwiched as it is without being tilted, by the first roller 64 and the second roller 65. Thus, the fold line F on the sheet P can be evenly sandwiched from both sides in the direction of the thickness of the sheet P and a uniform fold line F can be formed.

The space between the imaginary reference plane VP and the second nip NB is equal to or greater than the maximum thickness of the sheet bundle that can be folded. In this configuration, the fold line F on the sheet P when sandwiched by the first roller 64 and the second roller 65 can be arranged nearer to the first roller 64 than the imaginary reference plane VP regardless of the thickness of the sheet bundle. Thus, the bulge of the sheet P can be restrained from gathering to the side of the second roller 65 and the contact site of the first roller 64 and the second roller 65 with the sheet P can be restrained from becoming asymmetrical in relation to the fold line F. Therefore, the foregoing effects can be achieved more securely.

The second nip NB is located below the imaginary reference plane VP in the vertical direction. In this configuration, the sheet P, which can easily bulge upward with the fold line F hanging down due to gravity, can be supported without being lifted upward by the first roller 64. Thus, the bulge of the sheet bundle can be restrained from gathering in the +Z-direction. Also, the fold line F can be sandwiched by the first roller 64 and the second roller 65 without resisting a natural deformation of the sheet P due to gravity. Therefore, the fold line F can be restrained from being reinforced at a position shifted from a desired position.

The pair of folding rollers 44 can move toward and away from each other. In this configuration, the center in the direction of the thickness of the sheet P passed and folded through the space between the pair of folding rollers 44 is located on the imaginary reference plane VP regardless of the number of sheets P. If the first roller waits in such a way as to form the second nip on the imaginary reference plane VP, the first roller comes into contact with the bulge on the first roller side of the sheet P that has entered the fold-enhancing unit 45. If the first roller comes into contact with the bulge on the first roller side of the sheet P, the bulge of the sheet P gathers to the second roller side and the bulge on the second roller side increases. To cope with this, the first roller 64 is made to wait in such a way as to form the second nip NB nearer to the first roller 64 than the imaginary reference plane VP as described above. Thus, the bulge of the sheet P can be restrained from gathering to the side of the second roller 65. Therefore, the foregoing effects are achieved suitably.

The second control unit 90 controls the fold-enhancing unit 45 to enhance the fold line F on the sheet P, only if the number of sheets P passed through the first nip NA is equal to or greater than a predetermined number of sheets. In this configuration, the fold-enhancing of the fold line F is not performed on sheets P fewer than the predetermined number of sheets, which are less apt to bulge. Therefore, the processing speed can be improved.

In the first embodiment, the first roller 64 is not displaceable in the Z-direction. However, the first roller may be displaceable in the Z-direction. Even in this case, the foregoing advantageous effects are achieved by the first roller and the second roller forming the second nip as in the first embodiment.

The first embodiment is configured in such a way that the first roller 64 and the second roller 65 sandwich the fold line F on the sheet P. However, at least one of the first roller 64 and the second roller 65 may be replaced with a member that sandwiches the fold line F on the sheet P with the other roller and that moves in the Y-direction while sliding over the sheet P via the film of the support unit.

Second Embodiment

Figure 9:
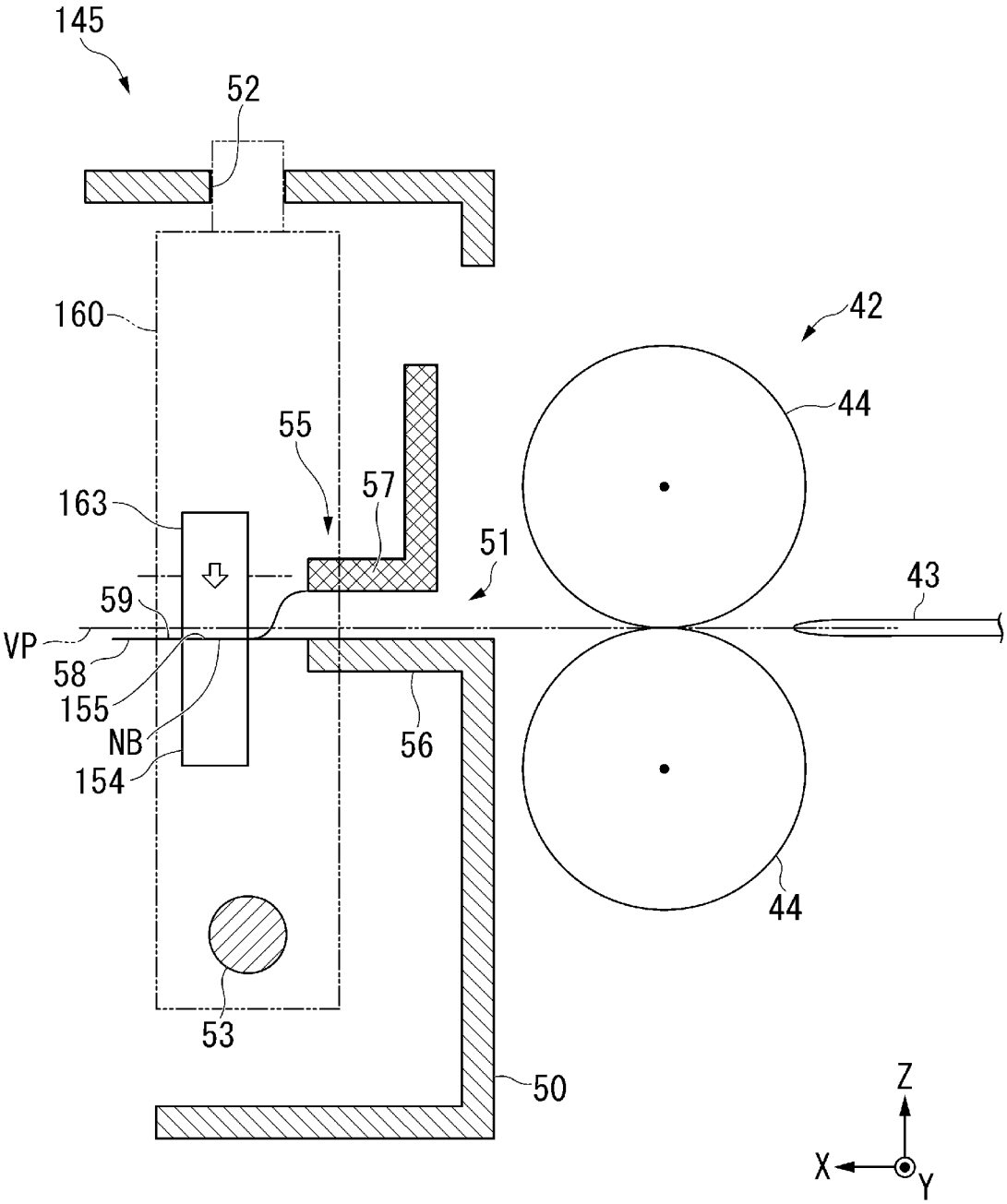
FIG. 9 is a front cross-sectional view showing a schematic configuration of a folding unit and a fold-enhancing unit in a sheet processing device according to a second embodiment.

FIG. 9 is a front cross-sectional view showing a schematic configuration of a folding unit 42 and a fold-enhancing unit 145 in a sheet processing device 200 according to a second embodiment. In the first embodiment shown in FIG. 4, the fold-enhancing unit 45 sandwiches the fold line F on the sheet P by the first roller 64 and the second roller 65. In the second embodiment shown in FIG. 9, the fold-enhancing unit 145 sandwiches the fold line F on the sheet P by an opposite member 154 (first member) and a fold-enhancing roller 163 (second member). The components other than the components described below are similar to those in the first embodiment.

As shown in FIG. 9, the fold-enhancing unit 145 has the opposite member 154 instead of the first roller 64 in the first embodiment. The opposite member 154 is supported by the frame 50. The opposite member 154 is not displaceable relatively to the frame 50. The opposite member 154 has a flat surface 155 facing in the +Z-direction. The flat surface 155 is an XY plane. The flat surface 155 has a length in the Y-direction. The flat surface 155 supports the fold line F on the sheet P over the entire length thereof via the first film 58.

The fold-enhancing unit 145 has a roller unit 160 instead of the roller unit 60 in the first embodiment. The roller unit 160 includes the roller frame 61 and the fold-enhancing roller 163. The roller frame 61 is arranged in such a way as to surround the opposite member 154 on the inner side of the opening 62.

The fold-enhancing roller 163 is configured similarly to the second roller 65 in the first embodiment. The fold-enhancing roller 163 is located in the +Z-direction from the opposite member 154. The fold-enhancing roller 163 is displaceable in the Z-direction in relation to the opposite member 154 and thus can move toward and away from the opposite member 154. The fold-enhancing roller 163 rolls over the flat surface 155 of the opposite member 154 via the first film 58 and the second film 59. The opposite member 154 and the fold-enhancing roller 163 come into contact with each other via the first film 58 and the second film 59 and thus form the second nip NB. The second nip NB is the contact area of the opposite member 154 and the fold-enhancing roller 163 in the case where the first film 58 and the second film 59 are not arranged. In this embodiment, the second nip NB coincides with the contact area of the first film 58 and the second film 59 between the opposite member 154 and the fold-enhancing roller 163. The second nip NB is parallel to the imaginary reference plane VP. The position in the Z-direction of the second nip NB is similar to the position in the first embodiment.

The fold-enhancing unit 145 in this embodiment enhances the fold line F on the sheet P in the following manner. The description of operations similar to those in the first embodiment is omitted.

When the V-folding mechanism 30 is not in operation, the roller unit 160 waits at the home position HP. At the home position HP, the fold-enhancing roller 163 shown in FIG. 9 is spaced apart from the opposite member 154 in the +Z-direction.

As the sheet P enters the fold-enhancing unit 145 and the fold line F on the sheet P is sandwiched between the first film 58 and the second film 59, the roller unit 160 moves in the +Y-direction from the home position HP. With the movement of the roller unit 160, the fold-enhancing roller 163 moves in the −Z-direction and approaches the opposite member 154.

Figure 10:
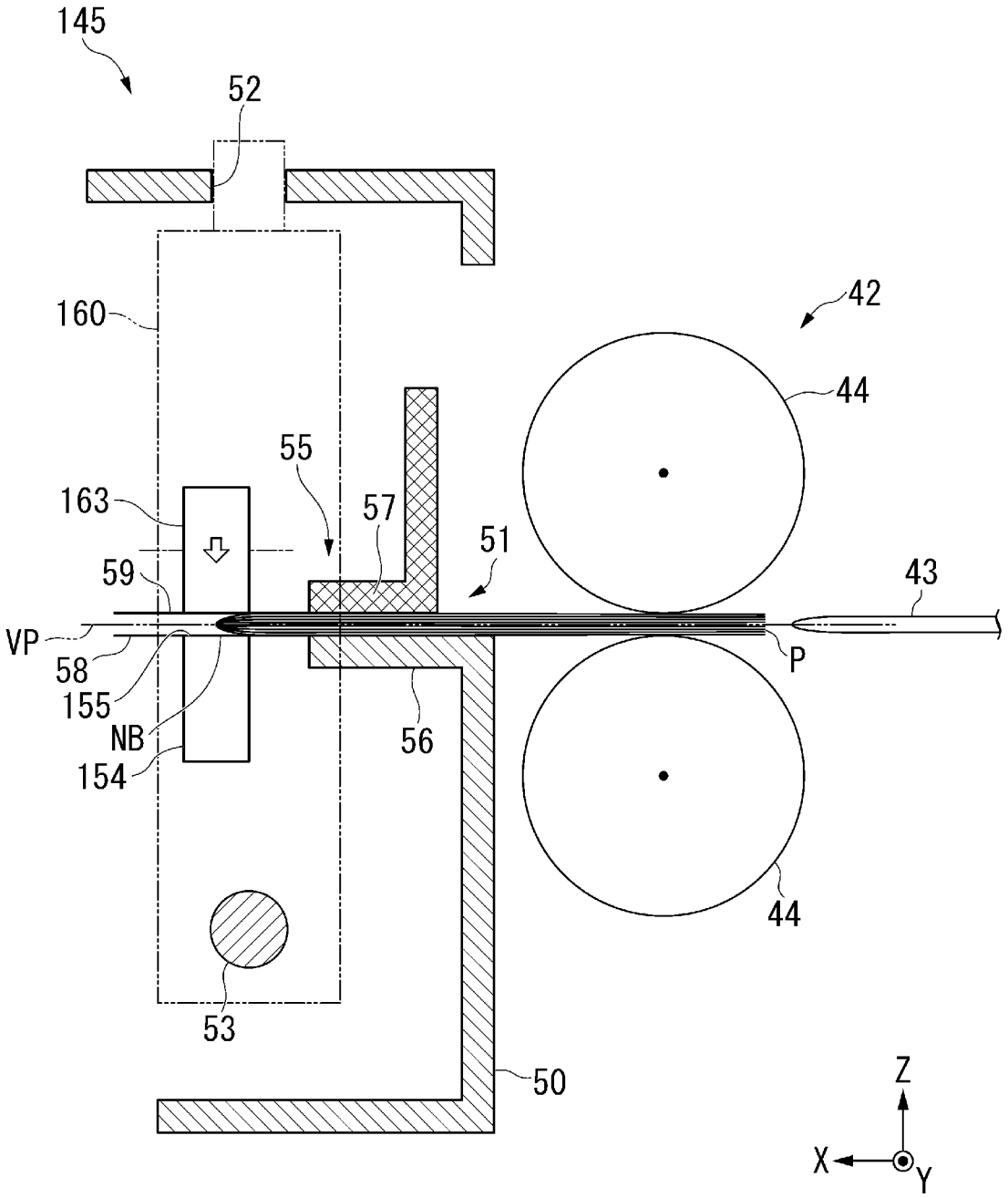
FIG. 10 is an explanatory view of an operation of the fold-enhancing unit.

FIG. 10 is an explanatory view of the operation of the fold-enhancing unit 145 shown in FIG. 9. As shown in FIG. 10, the opposite member 154 abuts against the surface in the −Z-direction of the first film 58. The fold-enhancing roller 163 abuts against the surface in the +Z-direction of the second film 59. The opposite member 154 and the fold-enhancing roller 163 sandwich the fold line F on the sheet P via the first film 58 and the second film 59. The fold-enhancing roller 163 presses the fold line F on the sheet P via the second film 59. The fold-enhancing roller 163 moves in the Y-direction along the fold line F. At this point, the fold-enhancing roller 163 rolls over the flat surface 155 of the opposite member 154 via the fold line F. Thus, the fold line F on the sheet P is enhanced.

This embodiment achieves effects similar to those of the first embodiment. In addition, in this embodiment, the fold-enhancing roller 163 and the opposite member 154 having the flat surface 155, which the fold-enhancing roller 163 rolls over, form the second nip NB. In this configuration, a fixed member that is not displaced can be used as the opposite member 154. Therefore, the number of movable parts can be reduced, compared with a configuration where a pair of rollers form the second nip. Thus, the configuration of the fold-enhancing unit 145 can be simplified.

The second embodiment is configured in such a way that the fold-enhancing roller 163 approaches the opposite member 154, which is not displaced in the Z-direction. However, a configuration where an opposite member approaches a fold-enhancing roller that is not displaced in the Z-direction may be employed.

In each of the above embodiments, the space between the imaginary reference plane VP and the second nip NB is equal to or greater than the maximum thickness of the sheet bundle that can be folded. However, the space between the imaginary reference plane VP and the second nip NB may be smaller than the maximum thickness of the sheet bundle that can be folded.

According to at least one of the above embodiments, a first member and a second member forming a second nip on one side of an imaginary reference plane along a direction of a normal line to the imaginary reference plane and sandwiching a fold line on a sheet are provided. This configuration can restrain the contact site of the first member and the second member with the sheet from becoming asymmetrical in relation to the fold line and can reinforce the fold line. Thus, a uniform fold line can be formed regardless of the number sheets.

While certain embodiments have been described, these embodiments have been presented by way of example only and are not intended to limit the scope of the present disclosure. Indeed, the novel embodiments described herein may be embodied in a variety of other forms. Furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A sheet processing device, comprising:

a pair of folding rollers provided rotatably about an axial line extending in an axial direction and configured to form a first nip;

a blade configured to push a sheet into the first nip along an imaginary reference plane including the first nip and form a fold line on the sheet in cooperation with the pair of folding rollers;

a fold-enhancing component configured to enhance the fold line on the sheet passed through the first nip, the fold-enhancing component comprising a first member and a second member that form a second nip on one side of the imaginary reference plane along a direction of a normal line to the imaginary reference plane and sandwich the fold line; and a controller configured to control the fold-enhancing component to enhance the fold line on the sheet, only if a number of sheets passed through the first nip is equal to or greater than a predetermined number of sheets, wherein both of the first member and the second member constitute a roller moving along the fold line.

2. The sheet processing device according to claim 1, wherein the fold-enhancing component causes the second member to approach the first member, the first member is not displaced in the direction of the normal line, and the first member and the second member sandwich the fold line.

3. The sheet processing device according to claim 1, wherein at least one of the first member and the second member comprises a flat surface which the one of the first member and the second member rolls over via the fold line.

4. The sheet processing device according to claim 1, wherein an axial line of rotation of the roller extends in a direction orthogonal to the axial line and the direction of the normal line.

5. The sheet processing device according to claim 1, wherein a space between the imaginary reference plane and the second nip is equal to or greater than a maximum thickness of a sheet bundle that can be folded.

6. The sheet processing device according to claim 1, wherein the second nip is located below the imaginary reference plane in a vertical direction.

7. The sheet processing device according to claim 1, wherein the pair of folding rollers are configured to move toward and away from each other.

8. A sheet processing method, comprising:

pushing, using a blade, a sheet into a first nip along an imaginary reference plane including the first nip and form a fold line on the sheet in cooperation with a pair of folding rollers, the pair of folding rollers provided rotatably about an axial line extending in an axial direction and configured to form the first nip;

enhancing the fold line on the sheet passed through the first nip using a fold-enhancing component, the fold-enhancing component comprising a first member and a second member that form a second nip on one side of the imaginary reference plane along a direction of a normal line to the imaginary reference plane and sandwich the fold line; and controlling the fold-enhancing component to enhance the fold line on the sheet, only if a number of sheets passed through the first nip is equal to or greater than a predetermined number of sheets, wherein both of the first member and the second member constitute a roller moving along the fold line.

9. The sheet processing method according to claim 8, further comprising:

causing the second member of the fold-enhancing component to approach the first member, the first member not displaced in the direction of the normal line, so that the first member and the second member sandwich the fold line.

10. The sheet processing method according to claim 8, further comprising:

moving the pair of folding rollers toward and away from each other.

11. An image forming apparatus, comprising:

an image forming component; and a sheet processing device, comprising:

a pair of folding rollers provided rotatably about an axial line extending in an axial direction and configured to form a first nip;

a blade configured to push a sheet into the first nip along an imaginary reference plane including the first nip and form a fold line on the sheet in cooperation with the pair of folding rollers;

a fold-enhancing component configured to enhance the fold line on the sheet passed through the first nip, the fold-enhancing component comprising a first member and a second member that form a second nip on one side of the imaginary reference plane along a direction of a normal line to the imaginary reference plane and sandwich the fold line; and a controller configured to control the fold-enhancing component to enhance the fold line on the sheet, only if a number of sheets passed through the first nip is equal to or greater than a predetermined number of sheets, wherein both of the first member and the second member constitute a roller moving along the fold line.

12. The image forming apparatus according to claim 11, wherein the fold-enhancing component causes the second member to approach the first member, the first member is not displaced in the direction of the normal line, and the first member and the second member sandwich the fold line.

13. The image forming apparatus according to claim 11, wherein a space between the imaginary reference plane and the second nip is equal to or greater than a maximum thickness of a sheet bundle that can be folded.

14. The image forming apparatus according to claim 11, wherein the second nip is located below the imaginary reference plane in a vertical direction.

* * * * *